US009343212B2

(12) United States Patent
Shinohara et al.

(10) Patent No.: US 9,343,212 B2
(45) Date of Patent: May 17, 2016

(54) REACTOR

(71) Applicants: Nobuki Shinohara, Toyota (JP); Shuichi Hirata, Nisshin (JP); Takeshi Okada, Kariya (JP); Yoshikazu Kamikawa, Okazaki (JP); Kazuo Hirasawa, Iida (JP)

(72) Inventors: Nobuki Shinohara, Toyota (JP); Shuichi Hirata, Nisshin (JP); Takeshi Okada, Kariya (JP); Yoshikazu Kamikawa, Okazaki (JP); Kazuo Hirasawa, Iida (JP)

(73) Assignees: TOYOTA JIDOSHA KABUSHIKI KAISHA, Toyota (JP); TOKAI KOGYO CO., LTD., Obu (JP)

( * ) Notice: Subject to any disclaimer, the term of this patent is extended or adjusted under 35 U.S.C. 154(b) by 96 days.

(21) Appl. No.: 14/169,272

(22) Filed: Jan. 31, 2014

(65) Prior Publication Data

US 2014/0218156 A1 Aug. 7, 2014

(30) Foreign Application Priority Data

Feb. 4, 2013 (JP) ..... 2013-019897

(51) Int. Cl.

| | |
|---|---|
| ***H01F 27/29*** | (2006.01) |
| ***H01F 27/30*** | (2006.01) |
| ***H01F 27/02*** | (2006.01) |
| ***H01F 5/04*** | (2006.01) |
| ***H01F 27/28*** | (2006.01) |
| ***H01F 37/00*** | (2006.01) |

(52) U.S. Cl.

CPC ..... *H01F 5/04* (2013.01); *H01F 27/022* (2013.01); *H01F 27/2852* (2013.01); *H01F 27/306* (2013.01); *H01F 37/00* (2013.01)

(58) Field of Classification Search

CPC ..... H01F 5/04; H01F 27/292; H01F 41/10; H01F 27/29; H01F 27/027; H01F 27/022; H01F 27/2852; H01F 27/306; H01F 37/00

USPC ..... 336/198, 192, 83, 96

See application file for complete search history.

(56) References Cited

U.S. PATENT DOCUMENTS

| | | | | |
|---|---|---|---|---|
| 4,315,232 | A * | 2/1982 | Spoldi et al. | 336/90 |
| 5,243,117 | A * | 9/1993 | Chang et al. | 585/467 |
| 5,423,117 | A | 6/1995 | Okada et al. | |
| 5,886,610 | A * | 3/1999 | Canova | 336/83 |

(Continued)

FOREIGN PATENT DOCUMENTS

| | | |
|---|---|---|
| JP | A-2009-54937 | 3/2009 |
| JP | 2010166013 A | 7/2010 |

(Continued)

OTHER PUBLICATIONS

Dec. 17, 2014 Office Action issued in Japanese Application No. 2013-019897.

(Continued)

*Primary Examiner* — Elvin G Enad
*Assistant Examiner* — Kazi Hossain
(74) *Attorney, Agent, or Firm* — Oliff PLC

(57) ABSTRACT

A reactor includes: a bobbin including flanges at ends of a winding range of a winding, at least one of the flanges being provided with a slit or a hole; a coil formed in a shape in which the winding having a lead portion is wound around the bobbin, the coil being molded by resin, and the lead portion penetrating through the slit or the hole; and a plate through which the lead portion of the coil penetrates, the plate contacting with a circumferential edge of the slit or the hole of the flange so as to close the slit or the hole.

3 Claims, 3 Drawing Sheets

(56) References Cited

U.S. PATENT DOCUMENTS

| | | | | |
|---|---|---|---|---|
| 6,559,749 | B1 * | 5/2003 | Weiner | 336/192 |
| 6,879,235 | B2 * | 4/2005 | Ichikawa | 336/200 |
| 8,334,745 | B2 * | 12/2012 | Chen et al. | 336/198 |
| 2009/0309686 | A1 * | 12/2009 | Espino | 336/182 |
| 2011/0260820 | A1 * | 10/2011 | Liao | 336/192 |
| 2012/0206230 | A1 * | 8/2012 | Liao et al. | 336/192 |
| 2013/0135072 | A1 | 5/2013 | Inaba | |

FOREIGN PATENT DOCUMENTS

| | | | |
|---|---|---|---|
| JP | A-2011-100842 | | 5/2011 |
| JP | A-2012-60053 | | 3/2012 |
| JP | 2013004531 | * | 1/2013 |
| JP | 2013004531 | A | 1/2013 |
| JP | 08078222 | A | 12/2014 |
| JP | 44023081 | Y | 12/2014 |
| JP | 61051720 | U1 | 12/2014 |
| TW | 271509 | B | 3/1996 |

OTHER PUBLICATIONS

Partial Translation of Oct. 9, 2015 Office Action issued in Chinese Patent Application No. 201410044198.3.

* cited by examiner

REACTOR

INCORPORATION BY REFERENCE

The disclosure of Japanese Patent Application No. 2013-019897 filed on Feb. 4, 2013 including the specification, drawings and abstract is incorporated herein by reference in its entirety.

BACKGROUND OF THE INVENTION

1. Field of the Invention

The present invention relates to a reactor. The "reactor" is a passive element using a coil, and is also referred to as an "inductor."

2. Description of Related Art

In recent years, a hybrid car and an electric vehicle have been put to practical use in earnest and widely spread. Since the hybrid car and the electric vehicle employ a motor as a driving source, an electric circuit for the motor often includes a reactor. The reactor is typically used in a convertor, circuit for increasing and decreasing a voltage. A main body of the reactor is configured such that a winding (a coil) is wound around a core. Ferrite is often used as the core.

In order to insulate the coil from its vicinal area, the coil may be entirely (or partially) molded by resin. Such a reactor is described, for example, in Japanese Patent Application Publication No. 2012-060053 (JP2012-060053 A) and Japanese Patent Application Publication No. 2011-1008422 (JP2011-1008422 A). A mold is often manufactured by injection molding of resin so as to adhere to the coil.

The reactors described in JP2012-060053 A and JP 2011-1008422 A do not include a bobbin, but some reactors employ a bobbin. The bobbin is provided with a flange on either side of a winding range of a winding. One of the flanges is provided with a slit for drawing a lead portion of a coil. Japanese Patent Application Publication No. 2009-054937 (JP2009-054937 A) describes a bobbin including such a flange equipped with a slit. Note that the lead portion indicates that part of the winding extending from an end of the coil which corresponds to a terminal of the coil.

SUMMARY OF THE INVENTION

In a case where a bobbin is used and a coil is molded by resin between a pair of flanges, that is, in a case where the coil is covered by injection molding of resin, it is necessary to seal a gap between a lead portion and that slit of the flange which draws the lead portion so that molten resin does not leak. The present specification provides a reactor which is able to fill a gap between a slit of a flange and a lead portion with a simple structure and which has a shape suitable for manufacture in which a coil is molded by resin between a pair of flanges.

A reactor according to one aspect of the present invention includes: a bobbin including flanges at ends of a winding range of a winding, at least one of the flanges being provided with a slit or a hole; a coil formed in a shape in which the winding having a lead portion is wound around the bobbin, the coil being molded by resin, and the lead portion penetrating through the slit or the hole; and a plate through which the lead portion of the coil penetrates, the plate contacting with a circumferential edge of the slit or the hole of the flange so as to close the slit or the hole.

In the reactor according to the aspect of the present invention, the plate may be configured to contact with the circumferential edge of the slit or the hole of the flange from the coil side.

In the reactor according to the aspect of the present invention, the plate may be configured to have a tapered shape in which the plate is tapered from the coil side toward a tip of the lead portion or to have a stepped shape in which the plate is small at a tip side of the lead portion while the plate is large at the coil side, and the tapered shape or the stepped shape of the plate contacts with the circumferential edge of the slit or the hole of the flange.

In the reactor according to the aspect of the present invention, a gate trace may be formed at time of resin injection molding. The gate trace may be placed on a portion of the coil being molded by the resin, and the gate trace may be placed between the flanges at the respective ends of the bobbin.

According to the reactor according to the aspect of the present invention, it is possible to fill a gap between the slit of the flange and the lead portion by the plate, thereby making it possible to prevent a resin mold between the flanges from leaking from the gap between the slit and the lead portion.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
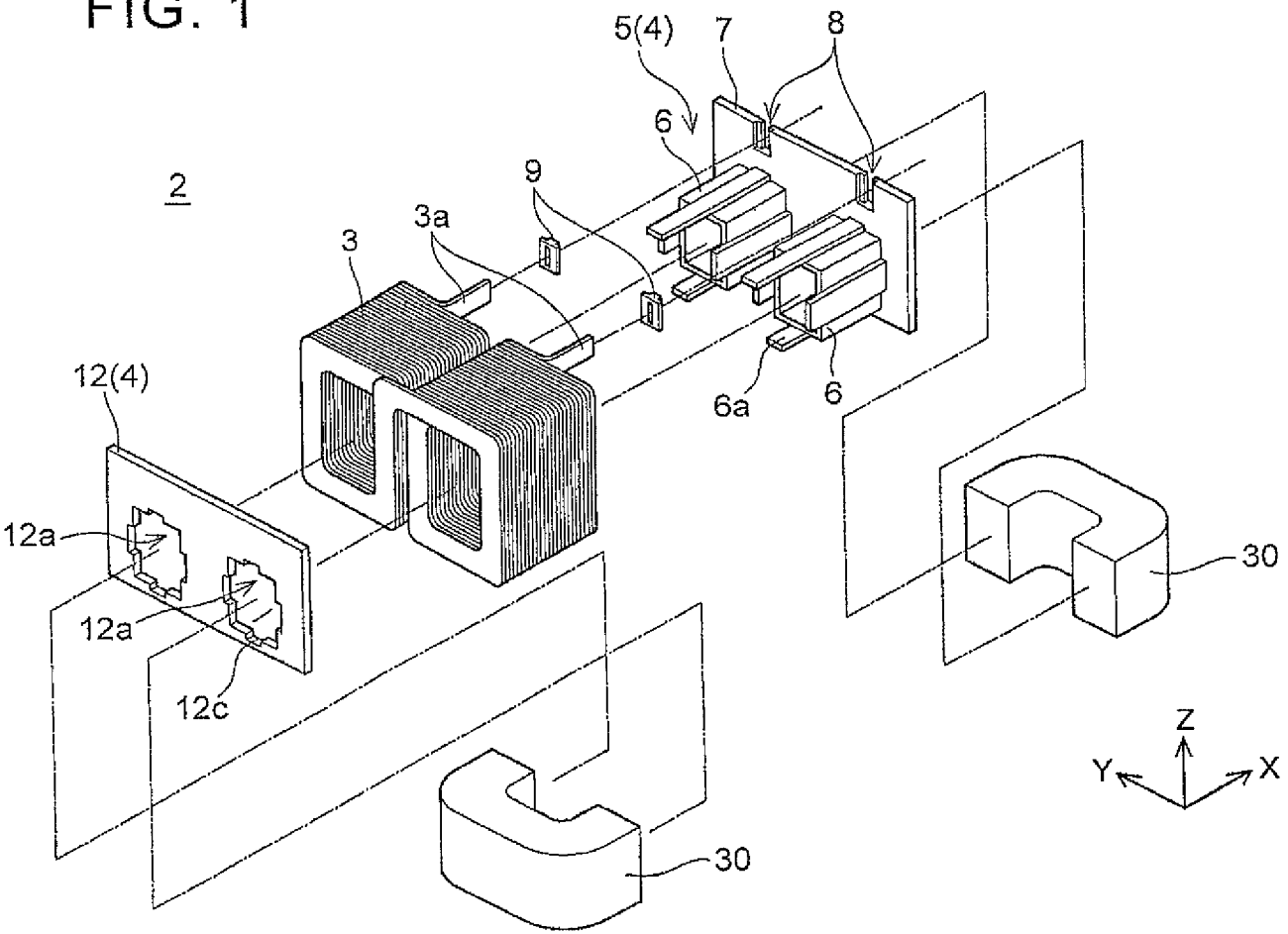
FIG. 1 is an exploded perspective view of a reactor (before injection molding)
Figure 2:
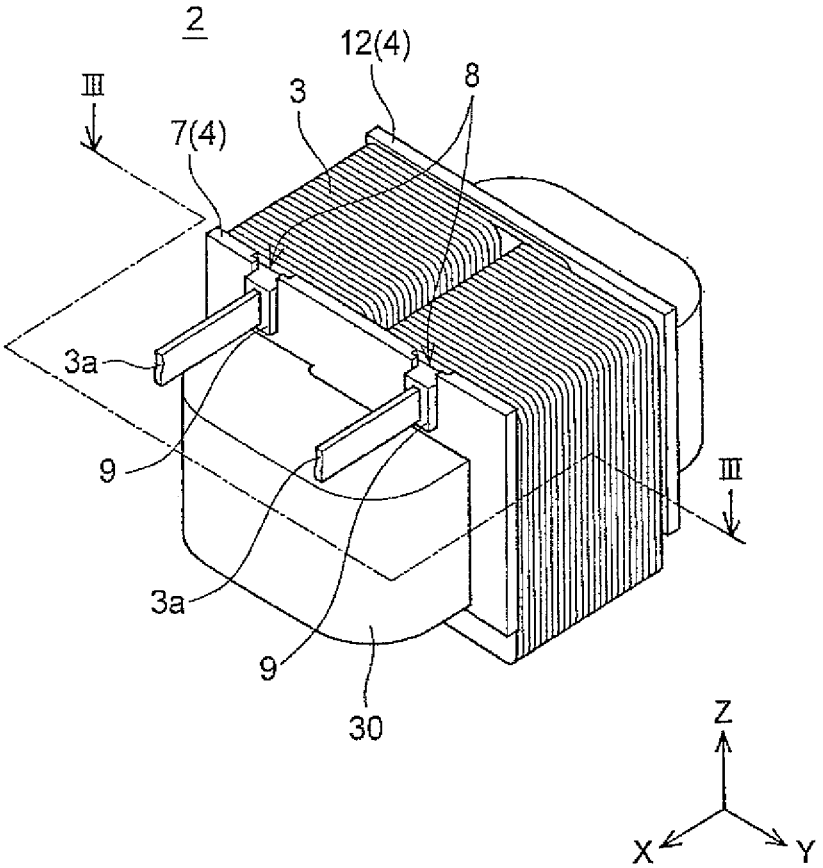
FIG. 2 is a perspective view of the reactor (before injection molding)

A reactor according to an embodiment is described with reference to the drawings. FIG. 1 is an exploded perspective view of a reactor 2 before injection molding (before a resin mold is formed on a partial surface of a coil), and FIG. 2 is a perspective view of the reactor 2 before injection molding (before the resin mold is formed on the partial surface of the coil). It should be noted that directions of an X-axis are different between FIG. 1 and FIG. 2. In FIG. 1, lead portions 3*a* of the coil extend from the bottom left toward the upper right, whereas in FIG. 2, the lead portions 3*a* extend from the upper right toward the bottom left.

The reactor 2 is used for a converter for increasing a battery voltage to a voltage suitable for motor driving in an electric vehicle, for example. Such a reactor 2 is a heavy-current reactor having a current permissible value of 100 [A] or more, and a flat wire is used as a wiring. The flat wire is a lead wire having a rectangular section and has a small electric resistance.

The following gives an outline of a structure of the reactor 2. The reactor 2 includes: two coils 3 serially-connected to each other and disposed so that their axes are parallel to each other; a bobbin 4 passed through the coils 3; and a pair of U-shaped cores 30 passing inside tubes of the bobbin 4.

The bobbin 4 is constituted by a main body 5 and an endplate 12. The main body 5 has such a structure that two tubular portions 6 project from a flange 7 so as to be parallel to each other along the two coils 3. The flange 7 corresponds to a flange for prescribing one end of a coil winding range.

The end plate 12 corresponds to a flange for prescribing the other end of the coil winding range. The coil has a shape in which the flat wire is wound in a substantially rectangular shape, and the tubular portion 6 also has a substantially rectangular shape. Ribs 6*a* extend from tips of four rectangular sides of the tubular portion 6. When the main body 5 and the end plate 12 are combined, the ribs 6*a* of the tips of the tubular portions 6 are fitted to cutouts 12*c* of holes 12*a* in the end plate 12 so as to be connected to each other, and thus the bobbin 4 is completed. Note that one tubular portion is provided with four ribs, and one hole 12*a* in the end plate 12 has four cutouts. However, in FIG. 1, for simplification of the view, respective reference signs "6*a*", "12*c*" are assigned to only one rib and one cutout, and no reference signs are assigned to the other ribs/cutouts. When the bobbin 4 is thus completed, a pair of flanges (the flange 7 and the end plate 12) prescribes the coil winding range. The pair of U-shaped cores 30 is incorporated from respective sides of the bobbin 4.

The flange 7 of the main body 5 is provided with slits 8 through which the lead portions 3*a* of the coil pass respectively. The lead portion 3*a* passes through the slit 8 as such, but a small plate 9 is disposed between the slit 8 and the lead portion 3*a*. The small plate 9 has a hole, so that the lead portion 3*a* is passed through the hole. The following describes the small plate 9 in detail. The small plate 9 is regarded as a "plate" described in Summary of the Invention.

Figure 3:
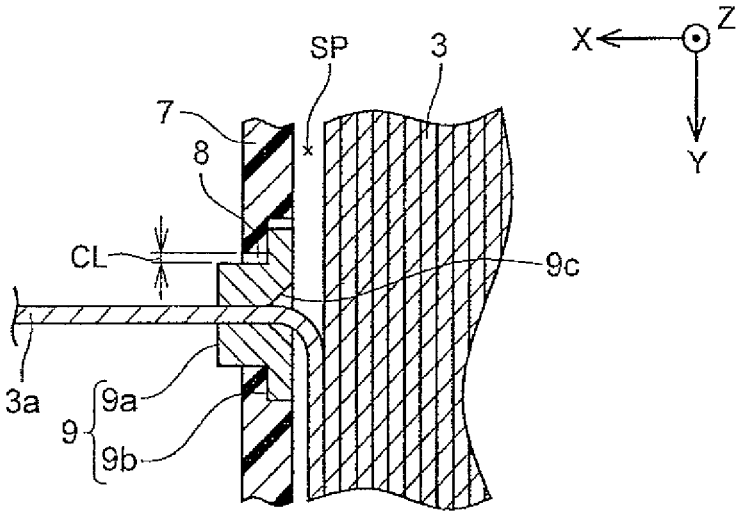
FIG. 3 is a sectional view around a slit, taken along an arrow III-III in FIG. 2.

FIG. 3 is a sectional view around the slit, taken along an arrow III-III in FIG. 2. Note that two slits 8 have the same structure, and therefore, only one of them is illustrated in FIG. 3. A step is provided in a circumference of the small plate 9, and the step engages with a step provided in the slit 8. The small plate 9 is constituted by a small-diameter portion 9*a* and a large-diameter portion 9*b* with the step sandwiched therebetween. The large-diameter portion 9*b* faces the coil 3, and the small-diameter portion 9*a* is placed on an opposite side to the coil. The hole of the small plate 9 has a size that allows the small plate 9 to be tightly fitted to the lead portion 3*a*, and surroundings of the lead portion 3*a* are sealed by the small plate 9. Further, the large-diameter portion 9*b* of the small plate 9 contacts with a circumferential edge of the slit 8 of the flange 7 from the coil 3 side, so as to close the slit. Accordingly, when the reactor 2 before injection molding as illustrated in FIG. 2 is placed in a die and resin is injected between the pair of flanges (the flange 7 and the end plate 12), the resin does not leak from between the slit 8 and the lead portion 3*a*. A molten resin at the time of injection molding is filled into a space indicated by a reference sign SP in FIG. 3. Hence, a pressure of the resin is added to the small plate 9 from the coil side. The pressure of the resin serves as a force to push the step of the small plate 9 against the step of the slit, and thus, a degree of adhesion between the small plate 9 and the circumferential edge of the slit increases. This prevents the resin from leaking from the slit 8.

Further, as illustrated in FIG. 3, a clearance CL is provided between the small plate 9 and a side surface of the slit 8. In other words, the clearance CL is a margin space in which the small plate 9 is slidable in a Y direction in the figure within the slit 8. Further, the rectangular small plate 9 is movable in a Z direction while being fitted to the slit 8. That is, the small plate 9 has a margin to move two-dimensionally in a plane of the flange. Due to this two-dimensional moving margin of the small plate 9, variations in a position of the lead portion 3*a* with respect to the flange 7 at the time of manufacturing multiple reactors are absorbed.

Figure 4:
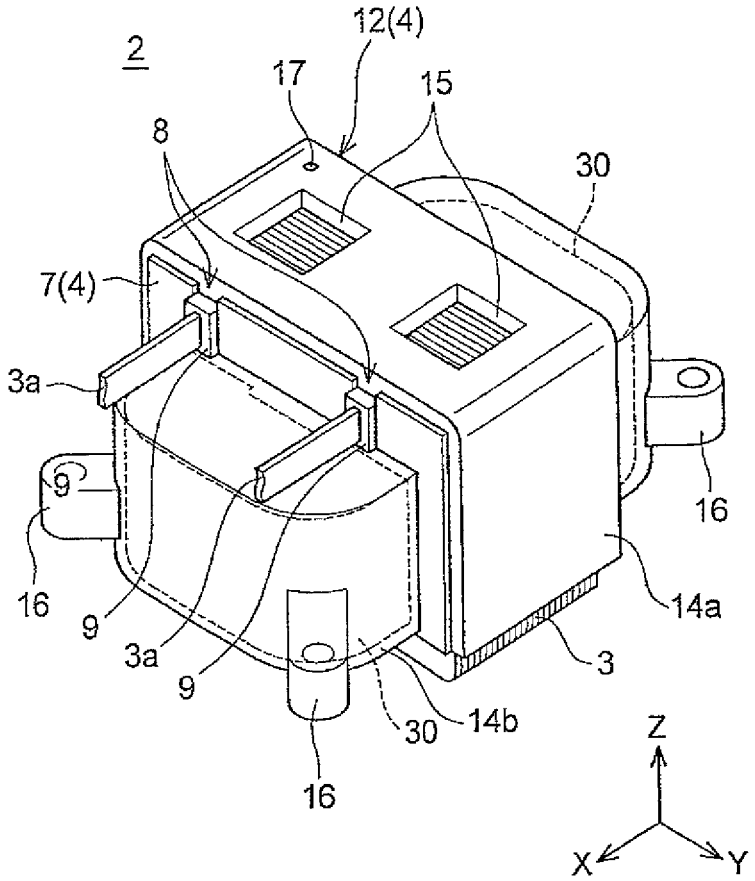
FIG. 4 is a perspective view of the reactor (after injection molding)

FIG. 4 is a perspective view of the reactor 2 after injection molding, i.e., a reactor as a finished-product. The coils 3 are molded by resin between the pair of flanges (the flange 7 and the end plate 12). A reference sign 14*a* indicates a resin mold coveting the coils 3. Note that the resin mold 14*a* has windows 15 in an upper side thereof, and part of the coils 3 is exposed from the windows. Further, bottom sides of the coils 3 are also exposed from the resin mold 14*a*. A reference sign 17 indicates a gate-trace. The gate trace corresponds to an opening of a gate (a resin injection hole) provided in a die when the reactor 2 is placed in the die at the time of injection molding, and the gate trace is formed in the resin mold 14*a*.

The resin mold 14*a* covers about half of a coil side of a thickness of the flange 7. As described above, the slits 8 for drawing the lead portions which slits 8 are formed in the flange 7 are sealed by the small plates 9, so that the resin does not leak from between the slits 8 and the lead portions 3*a*.

In the reactor 2, the cores 30 are also covered with the resin outside the flange 7 (on an opposite side to the coils 3). A reference sign 14*b* indicates a resin mold covering the cores. The resin mold 14*b* has fixing ribs 16 to fix the reactor 2 to a housing. The resin mold 14*b* is also manufactured by injection molding.

As described above, the reactor 2 includes the small plate 9 for filling a gap between the lead portion 3*a* and the slit 8. The technique described in the above embodiment employs the small plate 9 so as to provide such a structure that, in a reactor which employs a bobbin including a flange having a slit and in which a space between flanges is molded by resin, the resin does not leak from the slit at the time of injection molding.

Figure 5:
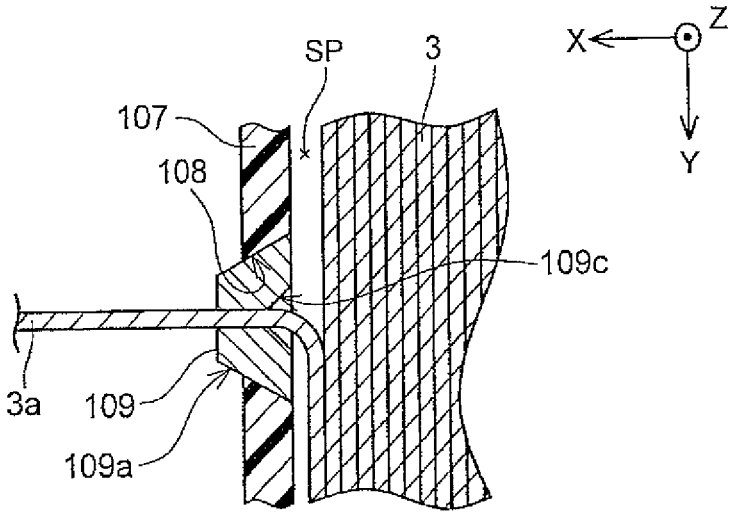
FIG. 5 is a sectional view around a slit in a reactor according to a modified embodiment.

Referring now to FIG. 5, a modified embodiment of the small plate 9 is described. FIG. 5 is a sectional view corresponding to FIG. 3. This modified embodiment employs a small plate 109 instead of the small plate 9 having a step. The small plate. 109 has a taper-shaped side surface that is tapered toward a tip direction of a lead portion. Further, a flange 107 used with the small plate 109 is provided with a slit 108 having a taper-shaped side surface. When coils 3 are assembled to a bobbin, a lead portion 3*a* is passed through the small plate 109, and the small plate 109 is fitted to the slit 108 so that a tapered portion is opposed to the slit 108. Even if a position of the lead portion 3*a* with respect to the slit 108 is displaced to some extent, the small plate 109 is guided by the tapered portion, so that the small plate 109 is fitted to the slit 108.

The following describes a point to keep in mind in regard to the technique described in the above embodiment. The reactor of the above embodiment is configured such that the slit to which the small plate is fitted is provided in the flange of the bobbin. The flange may have a hole to which the small plate is fitted, instead of the slit. The reactor of the above embodiment includes two coils arranged in parallel to each other. The technique disclosed in the present invention is not limited to two coils. The technique disclosed in the present invention is also applicable to a reactor having one simple coil.

The concrete embodiments of the invention have been described in detail, but these embodiments are only examples and do not limit the invention according to Claims. A technique according to Claims includes embodiments obtained by variously modifying or altering the concrete embodiments exemplified as above. Technical elements described in the present specification or the drawings exhibit a technical usability solely or in various combinations, and are not limited to combinations as described in Claims as of filing the present application. Further, the technique exemplified in the present specification or the drawings can achieve a plurality of objects at the same time, and has a technical usability by achieving one of those objects. For example, the slits may be provided in the flange so as to accord with the number of lead portions.

What is claimed is:

1. A reactor comprising:

a bobbin including flanges at ends of a winding range of a winding, at least one of the flanges being provided with two holes;

a coil including the winding, the coil being formed in a shape so as to have two lead portions and the winding wound around the bobbin, the coil being molded by resin, and the two lead portions respectively penetrating through each of the two holes; and two plates through which the two lead portions of the coil respectively penetrate, the two plates each respectively contacting circumferential edges of the two holes of the flange so as to close the two holes, the plates having a stepped shape in which the plates are smaller at a tip side than a coil side of the respective lead portion, and stepped portions of the plates abut with the circumferential edges of the two holes such that the plates are moveable within a margin.

2. The reactor according to claim 1, further comprising:

a gate trace formed at a time of resin injection molding, the gate trace is placed on a portion of the coil being molded by the resin, and the gate trace is placed between the flanges at the respective ends of the bobbin.

3. The reactor according to claim 1, wherein the two holes are two slits.

* * * * *